US011041356B2

(12) United States Patent
Craig et al.

(10) Patent No.: US 11,041,356 B2
(45) Date of Patent: Jun. 22, 2021

(54) WIRELINE SEALING ASSEMBLY

(71) Applicant: NATIONAL OILWELL VARCO UK LIMITED, Manchester (GB)

(72) Inventors: John Ronald Hartley Craig, Forfar (GB); George Alexander Senkbeil, Aberdeenshite (GB)

(73) Assignee: NATIONAL OILWELL VARCO UK LIMITED, Manchester (GB)

( * ) Notice: Subject to any disclaimer, the term of this patent is extended or adjusted under 35 U.S.C. 154(b) by 0 days.

(21) Appl. No.: 16/622,594

(22) PCT Filed: Jun. 6, 2018

(86) PCT No.: PCT/GB2018/051535

§ 371 (c)(1),
(2) Date: Dec. 13, 2019

(87) PCT Pub. No.: WO2018/229457

PCT Pub. Date: Dec. 20, 2018

(65) Prior Publication Data

US 2020/0347691 A1 Nov. 5, 2020

Related U.S. Application Data

(60) Provisional application No. 62/520,841, filed on Jun. 16, 2017.

(30) Foreign Application Priority Data

Oct. 13, 2017 (GB) ..... 1716832

(51) Int. Cl.
*E21B 33/072* (2006.01)

(52) U.S. Cl.
CPC ..... *E21B 33/072* (2013.01)

(58) Field of Classification Search
CPC ..... E21B 33/072
See application file for complete search history.

(56) References Cited

U.S. PATENT DOCUMENTS 3,467,394 A 9/1969 Bryant
3,762,725 A * 10/1973 Taylor ..... F16J 15/185 277/330

(Continued)

FOREIGN PATENT DOCUMENTS

WO WO-2018229457 A1 12/2018

OTHER PUBLICATIONS

"International Application Serial No. PCT/GB2018/051535, International Search Report dated Sep. 14, 2018", 4 pgs.

(Continued)

*Primary Examiner* — Kristyn A Hall
*Assistant Examiner* — Jonathan Malikasim
(74) *Attorney, Agent, or Firm* — Schwegman Lundberg & Woessner, P.A.

(57) ABSTRACT

A wireline sealing assembly adapted to seal a line such as wireline or slickline deployed in an oil or gas well has a body to receive a line and a seal adapted to be actuated into sealing engagement with the line to contain wellbore pressure within the well below the actuated seal. The seal comprises first and second seal members, each seal member comprising at least one sealing element, wherein the first and second seal members are formed of different materials. The second seal member may have a greater hardness rating or lower degree of resilience that the first seal member. The first and second seal members may radially deform against the line when the seal is actuated, and the first seal member may radially deform more than the second seal member. The seal may also comprise a third seal member comprising at least one sealing element, wherein the third seal member is (Continued)

formed of a different material to the first and second seal members.

15 Claims, 5 Drawing Sheets

(56) References Cited

U.S. PATENT DOCUMENTS

| | | | | |
|---|---|---|---|---|
| 4,307,783 | A | 12/1981 | Lanmon | |
| 6,394,460 | B1 | 5/2002 | Leggett | |
| 7,510,019 | B2 * | 3/2009 | Li | E21B 33/12 166/387 |
| 2011/0017444 | A1 | 1/2011 | Mccollin | |

OTHER PUBLICATIONS

"International Application Serial No. PCT/GB2018/051535, Written Opinion dated Sep. 14, 2018", 5 pgs.

* cited by examiner

SECTION A-A'

WIRELINE SEALING ASSEMBLY

RELATED PATENT APPLICATIONS

This application is a U.S. National Stage Filing under 35 U.S.C. 371 from International Application No. PCT/GB2018/051535, filed Jun. 6, 2018, which claims the benefit of U.S. Patent Application No. 62/520,841, filed on Jun. 16, 2017, and of UK Patent Application No. 1716832.9, filed on 13 Oct. 2017. Each of which are incorporated by reference herein in its entirety.

The present application relates to a wireline sealing assembly adapted to seal a line such as wireline or slickline being deployed in an oil or gas well. In particular, the application relates to a dynamic sealing device, which can be used to control well bore pressure during wireline intervention jobs, and which is adapted to seal against slick cable moving through the sealing assembly while containing wellbore pressure. The slick cable is typically jacketed with a smooth outer profile covering an internal armoured or load-bearing layer, such as one or more layers of braided wire.

Typically the sealing assembly comprises a housing disposed above the wellbore tubing or casing which incorporates a seal that is actuated to compress elastomeric sealing elements against the line, which provides a barrier to well pressure, maintaining the wellbore pressure within the well below the seal, but while allowing the line to move relative to the actuated sealing elements.

SUMMARY

The present invention provides a wireline sealing assembly comprising a body configured to receive a line for deployment in a well, and a seal adapted to be actuated into sealing engagement with the line in the body to contain wellbore pressure within the well below the actuated seal, wherein the seal comprises first and second seal members, the first seal member comprising at least one first sealing element, and the second seal member comprising at least one second sealing element, and wherein the first and second seal members are formed of different materials.

Optionally the first sealing element and the second sealing element are resilient, for example, they can each be formed of a (different) resilient material.

Optionally the second sealing element of the second seal member has a greater hardness rating than the elastomeric sealing element of the first seal member, for example, by being formed of a harder material. Optionally the second sealing element of the second seal member has a lower degree of resilience than the elastomeric sealing element of the first seal member, for example, by being formed of a less resilient material. Optionally the second sealing element of the second seal member comprises a backup sealing element, adapted to support the first sealing element.

Optionally when the seal is subjected to actuating pressure, both of the first and second seal members deform, optionally in a radial direction against the line, optionally radially inwards. Optionally the first seal member deforms more than the second. Optionally the deformation of the first and second seal members is resilient, and upon the removal of deforming forces, the first and second seal members resiliently recover towards their pre-energised states. Recovery can be complete or partial.

Optionally the seal comprises a third seal member, the third seal member comprising at least one (optionally more than one, e.g. two, three, four etc.) third sealing element. Optionally the third seal member has a greater hardness rating than the first or second seal members, and is optionally formed of a different material to the first and second seal members. Optionally the third seal member does not resiliently deform, and does not deform radially to any detectable extent upon the application of actuating force.

Optionally the first, second and third seal members each surround the line within the body and incorporate an aperture allowing passage of the line through the seal members, e.g. along the axis of the path of the line S.

Optionally the first seal member comprises a plurality of at least two, optionally three or more (e.g., four, five or six etc.) elastomeric sealing elements, optionally arranged in a stack where at least two of the plurality of elastomeric sealing elements are adjacent to each other and contiguous within the stack, and wherein the elastomeric sealing elements are aligned.

Optionally the second seal member comprises a plurality of at least two (optionally three, four or more) backup sealing elements, optionally arranged on opposite ends or sides of the stack of elastomeric sealing elements, and also optionally arranged in the stack in alignment with and optionally adjacent to and optionally abutting the end or outer faces of the elastomeric sealing elements. Optionally if more than two backup sealing elements are present, at least two of them are disposed in a contiguous arrangement adjacent to one another in the stack.

Optionally the third seal member comprises at least two (optionally three, four or more) third seal elements which are optionally also arranged in the stack in alignment with and optionally adjacent to and abutting the outer ends or faces of the backup sealing elements of the second seal member.

Optionally if more than two third sealing elements are present, at least two of them are disposed in a contiguous arrangement adjacent to one another in the stack, i.e. adjacent sealing elements are abutting within the stack.

Thus in one example, the elastomeric sealing element(s) of the first seal member is disposed in a central portion of the seal, the third sealing element(s) of the third seal member is disposed on one or more outer portions of the seal, and the backup sealing element(s) of the second seal member is disposed between the first and third seal members. Optionally the stack has axial symmetry along an axis of the path of the line.

Optionally the second seal member is contiguous with the first and third seal member and optionally all of the first, second and third seal members are arranged in an aligned stack, with the apertures for the line being in alignment within the stack.

Optionally the second seal member comprises a lower friction material than one of the first and third seal members. Optionally the second seal member has a smaller aperture than the first seal member when the seal is not actuated.

Optionally the clearance between the inner surface of the aperture on the first sealing member and the outer surface of the line is at least 5% of the line diameter and is optionally around 5-15% of the line diameter for example, 7-12%.

Optionally the clearance between the inner surface of the aperture on the second sealing member and the outer surface of the line is less than 5% of the line diameter and is optionally around 1-3% of the line diameter e.g. 1-2% but is typically as close to zero as is possible. Optionally the second seal member has a smaller aperture than the third seal member. Optionally the inner surface of the aperture of the second seal member engages and wears against the outer surface of the line, optionally simultaneously around the entire circumference of the line.

Optionally the third seal member is configured to compress the second and optionally the first seal member on actuation of the seal. Optionally the second seal member is configured to compress the first seal member on actuation of the seal.

Optionally the elastomeric sealing elements of the first seal member are adapted to deform more than the backup sealing elements of the second seal member. Optionally the backup sealing elements of the second seal member are adapted to deform more than the third sealing elements of the third seal member.

Optionally the second sealing elements are formed of plastics materials, for example, a polymeric plastic such as PTFE.

Optionally the third sealing elements of the third seal member are formed of metal, for example an alloy, for example, aluminium bronze, which optionally has a slight tendency to deform in response to actuation of the seal, but which deforms less than the second and first seal members in response to the same actuation force.

Optionally the seal is actuated by a piston which compresses the sealing elements. Optionally the piston moves along the axis of the path of the line, e.g. the axis of the aligned apertures in the stack of sealing elements. Optionally the piston is driven by a hydraulic fluid pressure actuated from a remote location for example, from the surface of the well at the wellhead or platform in the case of a subsea well.

Optionally at least two sealing assemblies are provided in a well, and optionally first and second sealing assemblies are axially spaced along the body, with respect to the axis of the path of the line. Optionally each sealing assembly has a respective piston or other actuator, and each can be controlled separately or by a common control.

In certain examples, the sealing assembly allows improved control of the actuation, for example using external hydraulic pressure and reduces the risks of pressure changes resulting from wellbore pressure within the well inadvertently energising the seal. This also typically leads to a reduction in the extrusion of the elastomer in the first seal member, as the surface pressures of the elastomer on the line can be controlled to the minimum required level to contain wellbore pressures in the well. This combination of features also helps to reduce damage to the line resulting from high forces applied to the elastomers and also reduces the force needed to pull the cable through the device when running in the hole. As further advantages, damage to the sealing elements is reduced as they are less likely to extrude from their designated positions in the sealing assembly. In some examples, it is also easier to apply equal sealing forces to each end of the sealing stack, resulting in improvements to "nipping" of seals at the upper end of the stack exposed to surface pressures. Various examples can also reduce cable damage (particularly damage to slick outer jackets of slickline cables) and reduce damage to the elastomers within the sealing assembly during use.

Some examples can increase the life of the sealing assembly, and increase the life of cables used in the assembly. Some examples also enable use of the seal assembly in higher-pressure wells.

Optionally, the elastomeric sealing elements of the first seal member are rubber, or some other elastomeric material. Optionally, the elastomeric sealing elements are adapted to deform radially inwards upon the application of axial force, for example by the action of the hydraulic piston being driven axially to compress the sealing elements.

The backup sealing elements of the second seal member are optionally located on the outer surfaces (for example above and below) the elastomeric sealing elements of the first seal member. The different material of the backup sealing elements of the second seal member typically have a greater hardness, and optionally a high degree of flexibility.

Optionally the central apertures through the backup sealing elements of the second seal member have a diameter as close as possible to the external diameter of the line passing through the sealing assembly, so as to reduce the extrusion gap between the inner diameter of the apertures through the backup sealing elements and the outer diameter of the line as close to zero as possible. This provides additional control of elastomer extrusion through the annulus between the aperture in the second seal member and the line, and helps to remove a high pressure "nipping" point.

As the cable or other line passes through the aperture(s) in the backup sealing element(s) of the second seal member the inner surface of the aperture is intended to contact the line around its circumference, and optionally to sacrificially wear against the surface of the line in order to close the gap completely. Optionally, the second seal members are formed of a low friction material, such as a polymer, for example PTFE, and this is useful because it permits a reduction of friction against the line when the seal is energised.

The third seal members typically provide mechanical support to the inner first and second sealing members. Optionally while the material of the third seal member is generally harder than the material of the second and first seal members, the material of the third seal member is still somewhat compliant and/or ductile, and optionally retains a degree of resilience to allow it to deform when subjected to force from the actuator. This reduces potential damage to the cable or other line which might occur if a harder metallic part (for example steel) were to be used in the event the line were to become de-centralised within the seal assembly as a result of mis-alignment during use.

The invention also provides a method of deploying a wireline in a well, the method comprising passing the wireline through a wireline sealing assembly comprising a body configured to receive a line for deployment in a well, and a seal adapted to be actuated into sealing engagement with the line in the body to contain wellbore pressure within the well below the actuated seal, and actuating the seal to contain wellbore pressures within the well while permitting movement of the wireline relative to the seal, wherein the seal comprises first and second seal members, the first seal member comprising at least one elastomeric sealing element, and the second seal member comprising at least one backup sealing element, and wherein the first and second seal members are formed of different materials.

Optionally the wireline can be slickline, e.g. coated line, and all variants of wireline including slickline will hereinafter be referred to as "line".

Optionally, the provision of two sealing assemblies, optionally having substantially identical arrangements, permits redundancy in the event of failure of hydraulic controlled, or wear of the seals, and provides redundancy to ensure containment of the wellbore pressure within the well.

Examples of the invention provide a sealing assembly in a dynamic cable sealing device intended for use with wireline cables jacketed with a polymer to form a smooth profile. The sealing assembly allows for control of the pressure applied to contain the well pressure and minimize extrusion of the sealing elements thereby giving longer seal life and reducing damage caused to the cable by previous sealing methods.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION

Figure 1:
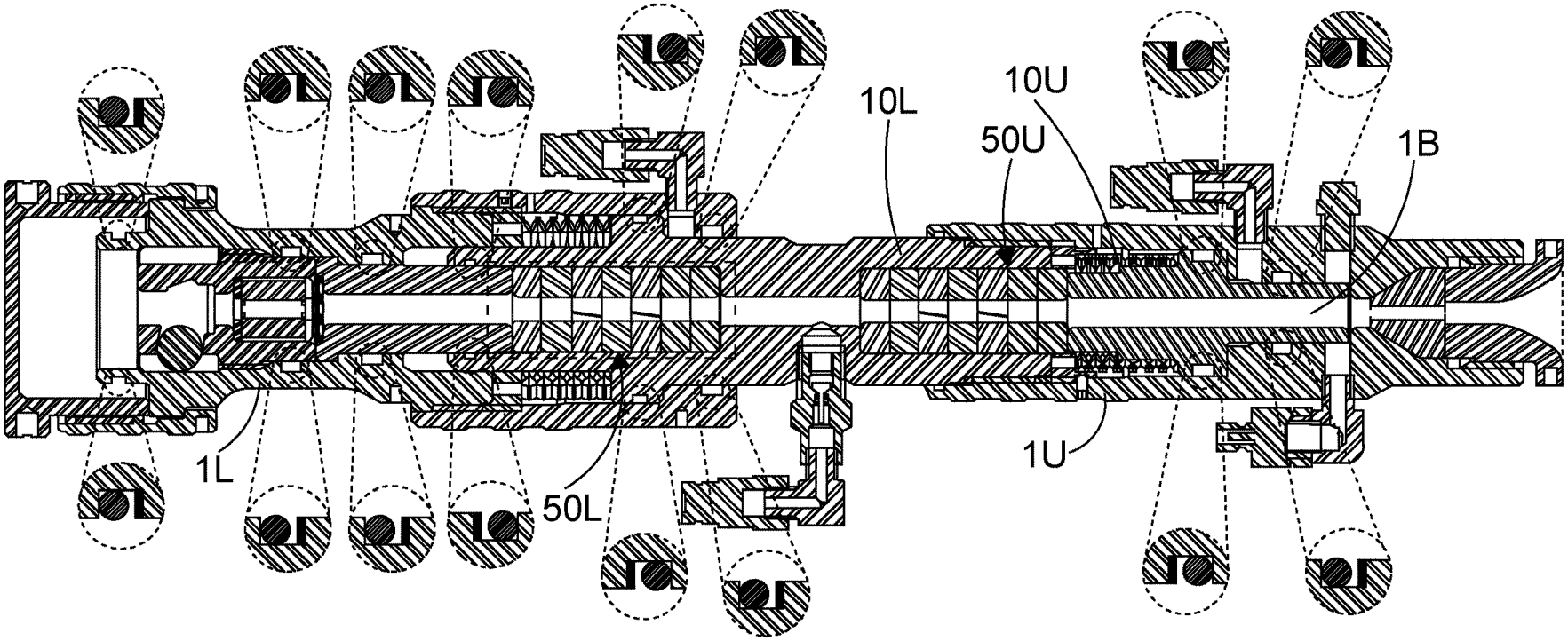
FIG. 1 shows a side sectional view of a sealing assembly.
Figure 2:
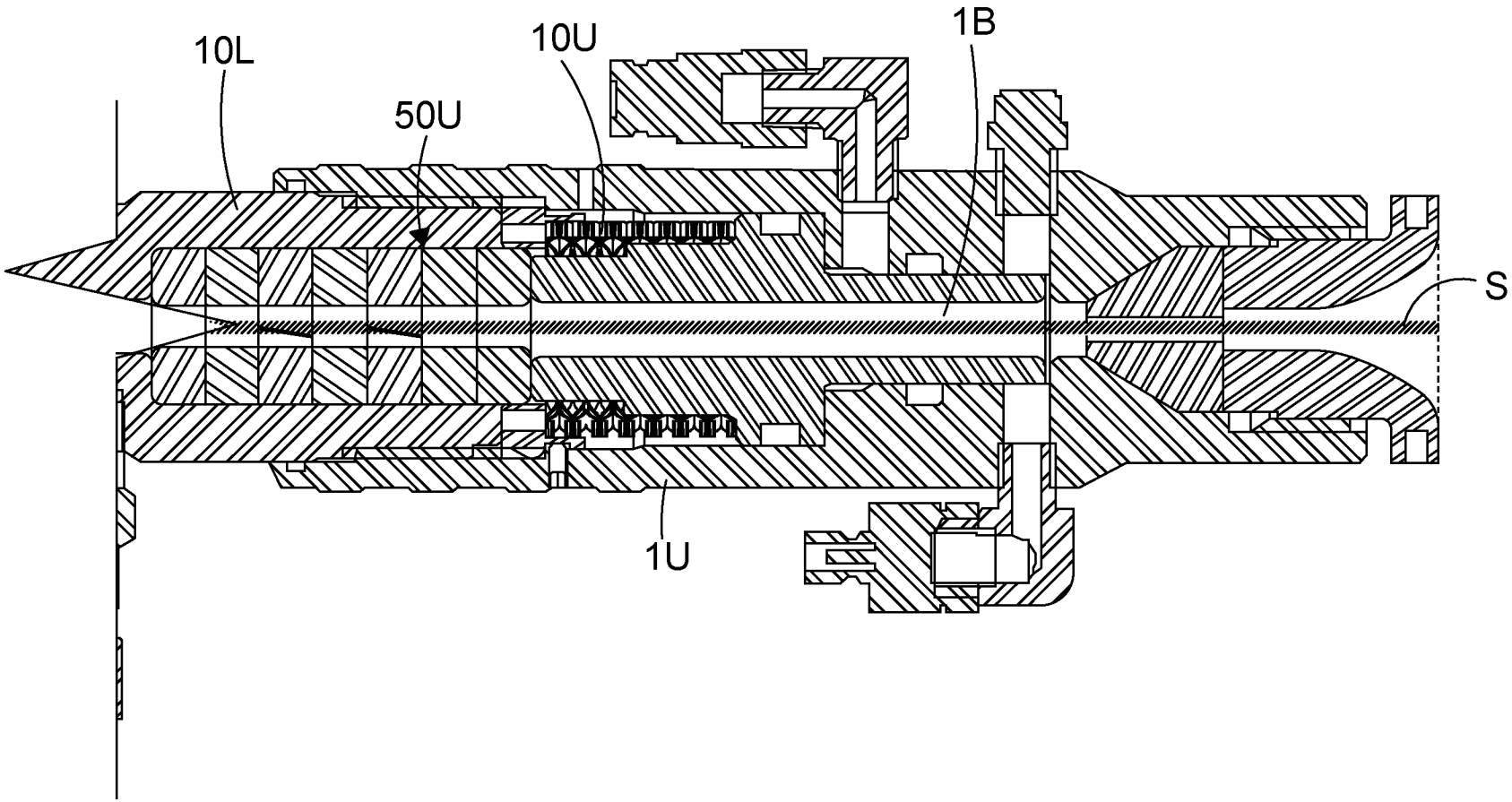
FIG. 2 shows a side sectional view similar to FIG. 1 with a slickline cable deployed through the sealing assembly into a well.

Referring now to the drawings, one example of a sealing assembly shown in FIG. 1 comprises a body having an upper body 1U and a lower body 1L having a central longitudinal axis and connected by a piston arranged in an upper piston 10U and lower piston 10L which is adapted to slide axially with respect to the body 1. The body 1 has a central axial bore 1B, which receives a line such as a wireline or slickline S adapted to be deployed in the well. The central bore 1B extends through both upper and lower parts of the body 1 and through the piston 10 guiding the line S along a straight pathway through the sealing assembly, as shown in FIG. 2.

The sealing assembly has a pair of seals 50U, 50L which seal the annulus between the inner surface of the body 1 and the outer surface of the line S. In this example, each seal 50U, 50L comprises a stack of sealing elements, and in this example, each seal 50U, 50L is substantially the same. Hence only the lower seal 50L will be described in detail.

Figure 3:
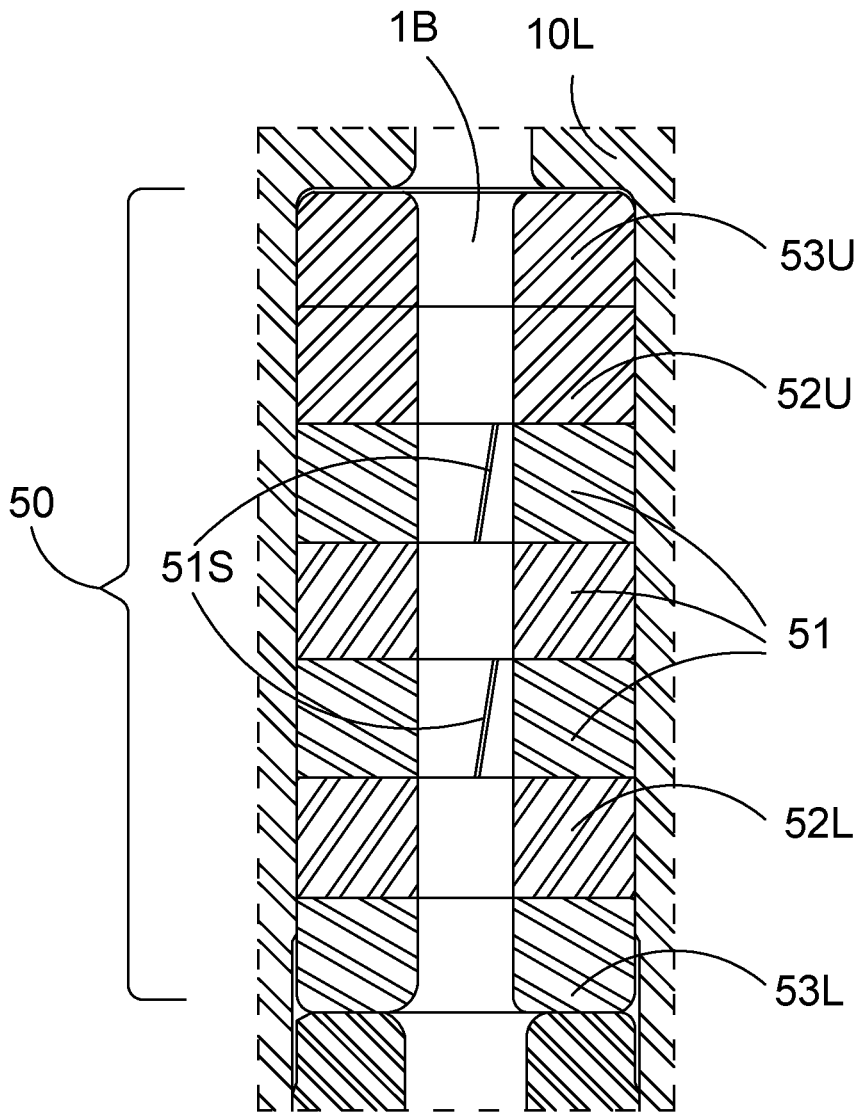
FIG. 3 shows a close up view of FIG. 1 showing a stack of sealing elements.

Referring to FIG. 3, the lower seal 50L comprises an axial stack of sealing elements, in a symmetrical arrangement along the axis of the central bore 1B. The stack has an upper end and a lower end, and a central portion. The central portion of the stack comprises the first seal member, which in this case comprises three contiguous elastomeric sealing elements 51 arranged in contact with one another in the stack. The elastomeric sealing elements 51 are circular and have a central aperture 51A aligned with the bore 1B and a scarf cut 51S between their radially outer surfaces and inner surfaces. The sealing elements 51 are formed from elastomeric material such as rubber, which is resilient and is adapted to expand resiliently into the aperture 51A upon axial compression of the sealing element 51 along the axis of the path of the line S (i.e. along the bore 1B). The scarf cuts 51S are provided to permit replacement of the sealing elements 51 without removing the other parts of the sealing assembly, and are optionally staggered out of phase with one another in the stack to reduce the extent of leakage through the scarf cuts when the seal 50L is actuated.

Figure 4:
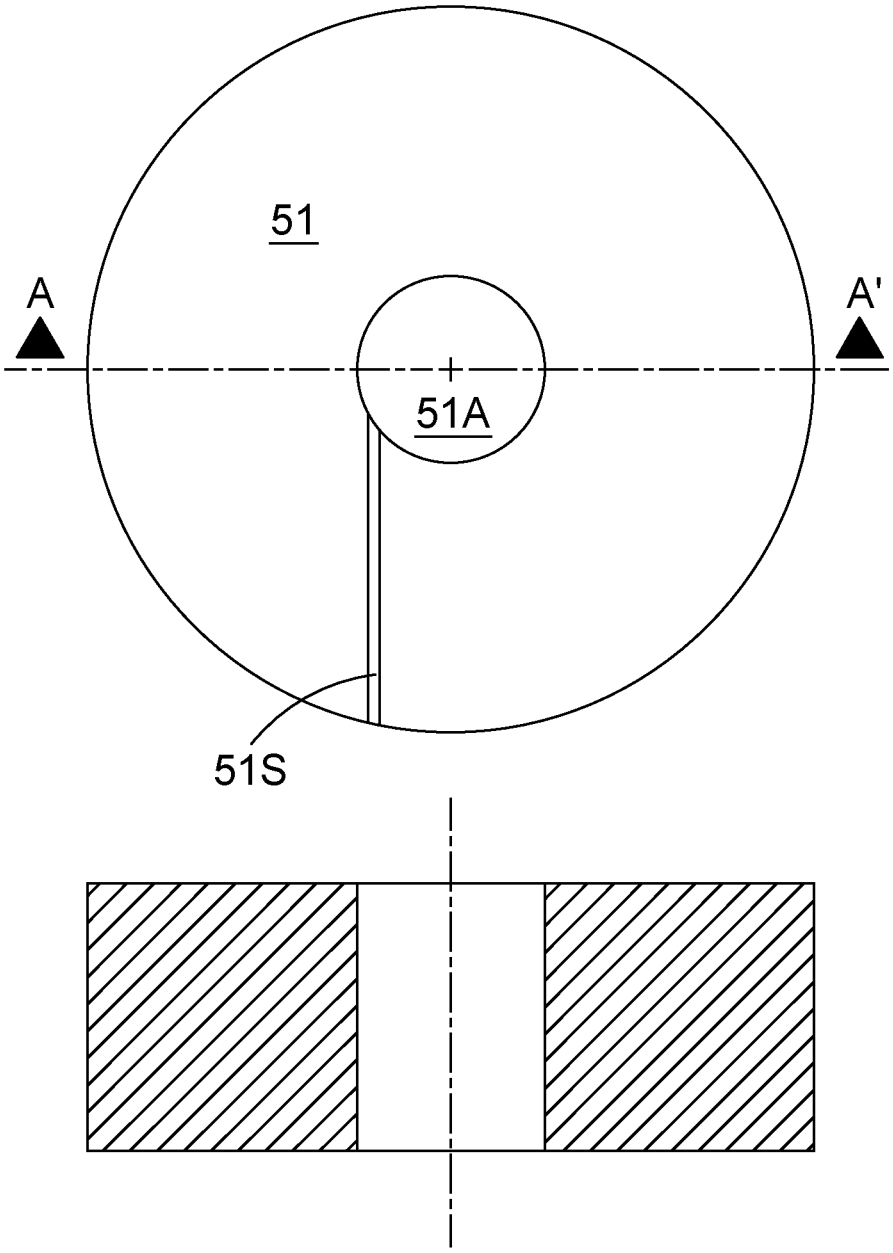
FIG. 4 shows a plan view of a first sealing element.

Referring to FIG. 4, the central aperture 51A of the sealing elements 51 has a nominal diameter creating an annulus (optionally of around 8-12% of line diameter in this example) between the inner surface of the sealing elements 51 and the outer surface of the line S when the line S is received in the sealing assembly. In this example, the clearance between the line and the inner surface of the sealing elements 51 is sufficient to permit the sealing elements 51 to resiliently recover back to their pre-energised states when the actuating force is removed.

The sealing elements 51 are sandwiched between a pair of second sealing elements 52U, 52L forming a second seal member, with one second sealing element 52U above the sealing elements 51, and one 52L below. The second sealing elements 52U, 52L are formed of a different material to the elastomeric sealing elements 51, and in this case are formed from PTFE. The second sealing elements 52U, 52L above and below the stack of first sealing elements 51 have a similar shape to the first elements 51, but do not in this example have a scarf cut, as they are less frequently replaced.

The PTFE material of the second sealing elements is able to resiliently deform and recover to its original shape when subjected to actuation force, but the degree of resilience of the second sealing elements 52U, 52L is lower in the second sealing element than in the first, and the second sealing element is harder than the first sealing element, so under the same deforming force applied to both, the first elastomeric sealing elements 51 deform radially inwards into the bore 1B more than the second sealing elements 52U, 52L.

Figure 5:
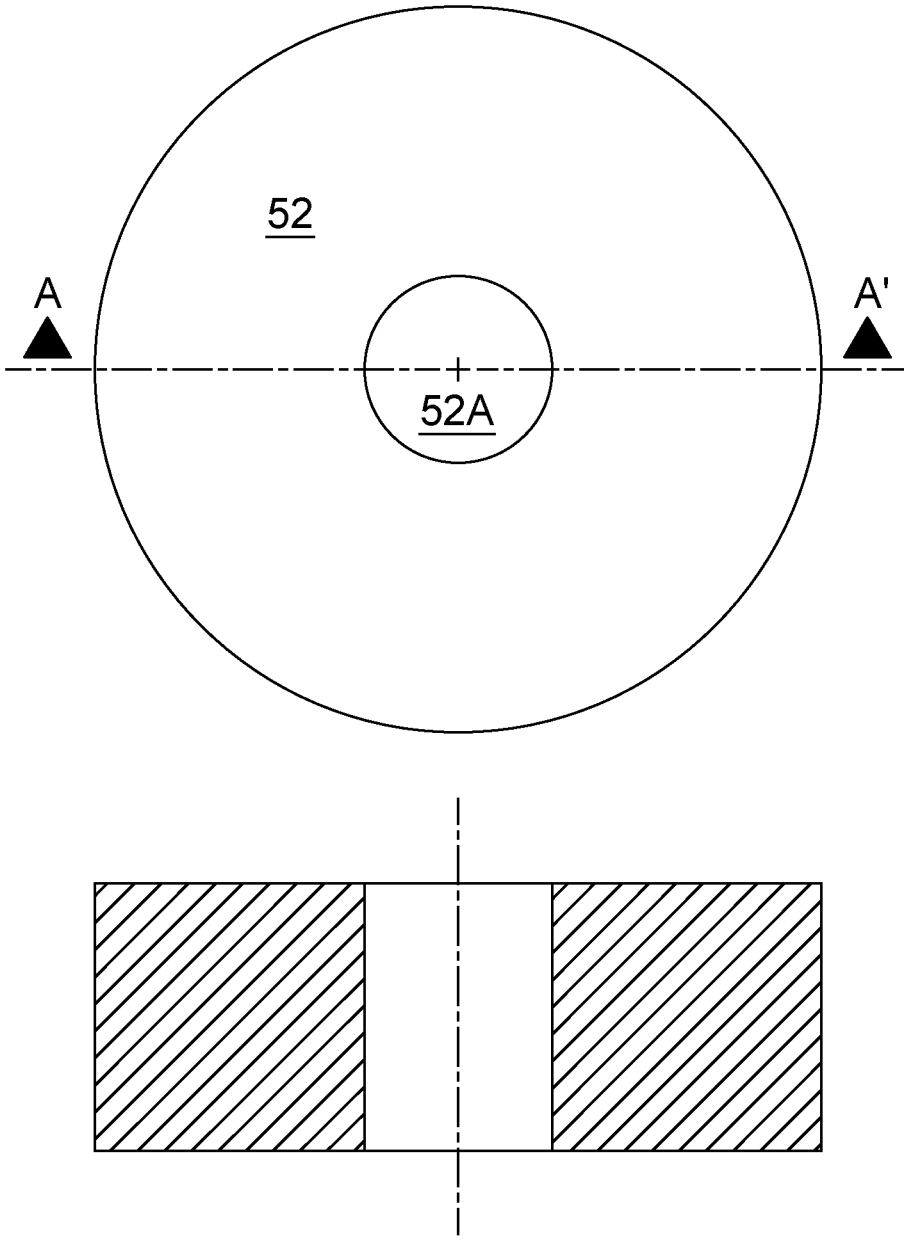
FIG. 5 shows a plan view of a second sealing element.

Referring to FIG. 5, the apertures 52A of the second sealing elements 52U, 52L are typically narrower than the apertures 51A of the first sealing elements 51, and have a closer tolerance to the outer diameter of the line S (optionally around 1-3% in this example) so that upon axial compression of the seal 50L, both the first and second sealing elements deform resiliently, but the first elements 51 deform more than the second elements 52U, 52L. Under the deforming force, the apertures 52A of the second elements 52U, 52L reduce in diameter, and advantageously compresses around the entire circumference of the line S, rubbing against it around the whole outer circumference, therefore closing the available gap for extrusion of the first sealing elements under the actuating force to a small gap approaching zero, and optionally closing the cap completely. The material of the second sealing elements 52U, 52L typically has a low coefficient of friction, typically lower than the material of the first sealing elements 51, but optionally each of the sealing elements 51, 52U, 52L can comprise a low friction material. Hence, the line S can typically slide easily against the material of the second sealing elements 52U, 52L, which typically wear sacrificially as a result of rubbing against the line S around its circumference.

On the outer surfaces of the second sealing elements 52U, 52L, there is a pair of third sealing elements 53U, 53L, formed of another different material, in this case, from an alloy such as Aluminium Bronze. The third sealing elements do not substantially deform in response to applied force during actuation.

The upper and lower seals 50U, 50L are typically energised by axial compression by a hydraulic piston although other methods are possible. Each seal 50U, 50L is optionally energised by the same hydraulic force, although each could be under the control of a separate hydraulic circuit. When the hydraulic piston is actuated, optionally by control from the surface, the piston is driven axially in the body to compress the seals 50U, 50L and cause each of the first and second sealing elements 51, 52U, 52L to deform radially inwards against the line S to seal the annulus between the line S and the body 1. This contains the wellbore pressure.

Because the sealing elements 51, 52U, 52L are made of different materials, each deforms to a different extent, and this enables the apertures 52A in the second sealing elements 52U, 52L to be closely toleranced to the line S, while the apertures 51A in the first elements 51 generally have to expand a larger distance to contact the line. Thus, upon deformation of both of the first and second sealing elements 51, 52U, 52L, the inner array of first sealing elements 51 absorbs a large amount of energy during the compression, and this enables the resilient recovery of the first sealing elements 51 back into their pre-energised configurations upon the removal of actuating force. However, the second sealing elements 52U, 52L are less resilient and optionally harder, and deform less in response to the same force, and so in response to the actuating force, the second sealing elements 52U, 52L deform to a lesser extent than the first sealing elements 51 but still close the annulus. Since the second sealing elements 52U, 52L are less resilient than the first sealing elements 51, they contain the first sealing elements and resist extrusion of them through the annular gap. Upon removal of the force actuating the seals 50U, 50L, both the first and second sealing elements resiliently recover to withdraw radially from the outer surface of the line S.

The third sealing elements 53U, 53L do not substantially react to the actuation force by deforming, and the apertures therein remain unchanged, resulting in a very small amount of extrusion of the PTFE material of the second sealing elements 52U, 52L into the apertures of the third sealing elements 53 during actuation. This helps to contain the wellbore pressure within the well.

Because of the different materials in the sealing elements 51, 52U, 52L (and optionally 53U, 53L) the surface pressures on the outer surface of the line S can be controlled to the minimum required to seal and contain the wellbore pressure, which reduces damage on the line S and the sealing elements 51, 52U, 52L, and reduces the force needed to pull the line S through the sealed assembly when running in the hole. As well as reducing general wear on the sealing elements 51, 52U, 52L pressed against the line S, the combination of features reduces the likelihood of extrusion damage to the sealing elements 51, 52U, 52L.

Furthermore, the combination of features allows the construction of sealing assemblies which are easier to control, as the first sealing elements 51 can be constructed to have a larger rebound force reducing the risk of wellbore pressure prematurely activating the seal in the absence of a deliberate actuation force. In some examples, the seals 51 can be constructed with a large annular clearance between the line S and the sealing element 51 so that they need to be radially compressed by some distance and at some force in order to make the seal. This means that the un-energised sealing elements 51 are less susceptible to being inadvertently initiated by well bore pressure applied below the seal, and allows better control over actuation, since the well bore pressure cannot easily over-ride the deliberate hydraulic control, and thus wellbore pressure has less effect on how hard the sealing elements are pressed against the line S. The fact that the sealing elements are less susceptible to inadvertent actuation also minimises wear on the line S and sealing elements 51, 52U, 52L, since the sealing elements 51, 52U, 52L are only activated in response to deliberate actuation.

The invention claimed is:

1. A wireline sealing assembly comprising a body configured to receive a line for deployment in a well, and a seal adapted to be actuated into sealing engagement with the line in the body to contain wellbore pressure within the well below the actuated seal, wherein the seal comprises first, second, and third seal members, the first seal member comprising at least one first sealing element, and the second seal member comprising at least two second sealing elements arranged on opposite sides of the first seal member, and wherein the first and second seal members are formed of different materials, wherein the third sealing member comprises at least two third sealing elements, the third sealing elements being formed of a different material to at least one of the first and second seal members, and the third sealing elements being arranged in a stack of sealing elements in alignment with and abutting outer faces of the second sealing elements of the second seal member, wherein each of the first, second and third seal members has an aperture to accommodate the line, and wherein the aperture of the second seal member is smaller than the apertures of the first and third seal members.

2. The wireline sealing assembly as claimed in claim 1, wherein the first sealing element and the second sealing element are resilient.

3. The wireline sealing assembly as claimed in claim 1, wherein the second sealing element of the second seal member has a greater hardness rating than the first sealing element of the first seal member.

4. The wireline sealing assembly as claimed in claim 1, wherein when the seal is subjected to actuating pressure, both of the first and second seal members are adapted to deform in a radial direction against the line, and wherein the first sealing element of the first seal member is adapted to deform in a radial direction more than the second sealing element of the second seal member.

5. The wireline sealing assembly as claimed in claim 1, wherein the third seal member has a greater hardness rating than the first or second seal members.

6. The wireline sealing assembly as claimed in claim 1, wherein the first seal member comprises a plurality of at least two first sealing elements, and wherein each of said first sealing elements are elastomeric.

7. The wireline sealing assembly as claimed in claim 6, wherein the first sealing elements are arranged in a stack where at least two of the plurality of first sealing elements are adjacent to each other and contiguous within the stack, and wherein the first sealing elements are aligned within the stack.

8. The wireline sealing assembly as claimed in claim 1, wherein at least one first sealing element of the first seal member is disposed in a central portion of the seal, at least one third sealing element of the third seal member is disposed on at least one outer portion of the seal, and the second sealing element of the second seal member is disposed between the first seal member and the third seal member.

9. The wireline sealing assembly as claimed in claim 1, wherein the first and second sealing elements are arranged in a stack which has axial symmetry along an axis of a path of the line.

10. The wireline sealing assembly as claimed in claim 1, wherein the second seal member is contiguous with the first seal member.

11. The wireline sealing assembly as claimed in claim 1, wherein a coefficient of friction of the material of the second seal member is lower than a coefficient of friction of the material of the first seal member.

12. The wireline sealing assembly as claimed in claim 1, wherein each of the first and second seal members has an aperture to accommodate the line, and wherein the aperture of the second seal member is smaller than the aperture of the first seal member.

13. The wireline sealing assembly as claimed in claim 1, wherein an inner surface of the aperture of the second seal member engages and wears against an outer surface of the line.

14. A wireline sealing assembly comprising a body configured to receive a line for deployment in a well and a seal adapted to be actuated into sealing engagement with the line in the body to contain wellbore pressure within the well below the actuated seal, wherein the seal comprises first, second, and third seal members, the first seal member comprising at least one first sealing element, and the second seal member comprising at least two second sealing elements arranged on opposite sides of the first seal member, and wherein the first and second seal members are formed of different materials, wherein the third seal member comprises at least two third sealing elements, the third sealing elements being formed of different material to one of the first and second seal members, and the third sealing elements being arranged in a stack of sealing elements in alignment with and abutting outer faces of the second sealing elements of the second seal member, wherein the third sealing elements of the third seal member are formed of a metal alloy which deforms less than the second and first seal members in response to the same actuation force.

15. A method of deploying a wireline in a well, the method comprising passing the wireline through a wireline sealing assembly comprising a body configured to receive a line for deployment in a well, and a seal adapted to be actuated into sealing engagement with the line in the body to contain wellbore pressure within the well below the actuated seal, and actuating the seal to contain wellbore pressures within the well while permitting movement of the wireline relative to the seal, wherein the seal comprises first second, and third seal members, the first seal member comprising at least one elastomeric sealing element, and the second seal member comprising at least two second sealing elements arranged on opposite sides of the first seal member, and wherein the first and second seal members are formed of different materials, wherein the third seal member comprises at least two third sealing elements, the third sealing elements being formed of a different material to one of the first and second seal members, and the third sealing elements being arranged in a stack of sealing elements in alignment with and abutting outer faces of the second sealing elements of the second seal member, wherein each of the first, second and third seal members has an aperture to accommodate the line, and wherein the aperture of the second seal member is smaller than the apertures of the first and third seal members.

* * * * *